US007815278B2

(12) United States Patent
Unosawa et al.

(10) Patent No.: US 7,815,278 B2
(45) Date of Patent: Oct. 19, 2010

(54) DROPLET DISCHARGE-CONDITION DETECTING UNIT, DROPLET-DISCHARGING DEVICE, AND INKJET RECORDING DEVICE

(75) Inventors: Yasuhiro Unosawa, Tokyo (JP); Tadashi Yamamoto, Yokohama (JP); Takuya Tsujimoto, Kawasaki (JP); Yasutaka Mitani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 928 days.

(21) Appl. No.: 11/448,189

(22) Filed: Jun. 7, 2006

(65) Prior Publication Data

US 2006/0279601 A1 Dec. 14, 2006

(30) Foreign Application Priority Data

Jun. 14, 2005 (JP) ..... 2005-173081

(51) Int. Cl.
*B41J 29/393* (2006.01)
*B41J 29/38* (2006.01)
*B41J 2/15* (2006.01)

(52) U.S. Cl. ..... 347/19; 347/9; 347/40

(58) Field of Classification Search ..... 347/9, 347/19, 40

See application file for complete search history.

(56) References Cited

U.S. PATENT DOCUMENTS 5,703,860 A * 12/1997 Fukunaga et al. ..... 347/242
2003/0202040 A1* 10/2003 Shade ..... 347/40

FOREIGN PATENT DOCUMENTS

| | | |
|---|---|---|
| JP | 04-191051 | 7/1992 |
| JP | 11-192726 A | 7/1999 |
| JP | 11-258044 | 9/1999 |
| JP | 2001-071476 | 3/2001 |
| JP | 2003-039667 | 2/2003 |
| JP | 2003-276171 A | 9/2003 |
| JP | 2005-017019 | 1/2005 |
| JP | 2005-066454 | 3/2005 |

* cited by examiner

*Primary Examiner*—Matthew Luu
*Assistant Examiner*—Jannelle M Lebron
(74) *Attorney, Agent, or Firm*—Canon U.S.A., Inc. I.P. Division

(57) ABSTRACT

A detection unit to optically detect a discharge condition of a droplet is disclosed. The detection unit includes a light emitting element and a light receiving element disposed on opposite sides of an area through which a droplet discharged from a droplet-discharger passes. A diaphragm plate having an aperture and another diaphragm plate having at least two apertures arranged at a pitch in a discharge direction are respectively disposed near front surfaces of the two elements. When light emitted from the light emitting element passes through the apertures, two light beams are received by the light receiving element. When the droplet is discharged and passes in front of the apertures, the two light beams are blocked sequentially by the ink droplet, which causes the quantity of light received by the light receiving element to change, thereby inducing a change in an output from the light receiving element. Based on the change in the output, a discharge-condition of the droplet is determined.

19 Claims, 10 Drawing Sheets

DROPLET DISCHARGE-CONDITION DETECTING UNIT, DROPLET-DISCHARGING DEVICE, AND INKJET RECORDING DEVICE

BACKGROUND OF THE INVENTION

1. Field of the Invention

The present invention relates to a droplet discharge-condition detecting unit configured to optically detect a discharge condition of a droplet discharged from a droplet discharger of a droplet-discharging device, such as an ink droplet discharged from a recording head of an inkjet recording device. The present invention also relates to a droplet-discharging device, such as an inkjet recording device, equipped with such a droplet discharge-condition detecting unit.

2. Description of the Related Art

Inkjet recording devices have the following advantages. For example, inkjet recording devices allow recording heads to be made compact, can record high resolution images at high speed, can perform recording on standard paper without any special treatments, require low running costs, have low noise, and can readily perform color-image recording.

However, in inkjet recording devices, there are cases where ink droplets are not discharged from a recording head (which will be referred to as "defective discharge" hereinafter) or the discharge direction is deflected to cause ink droplets to be discharged in an improper direction (which will be referred to as "deflective discharge" hereinafter). For example, the defective discharge and deflective discharge may be caused if the nozzles of the recording head are clogged with dust or thickened ink. The defective discharge and deflective discharge can also be caused if heaters are disconnected in a case where the device is a type that discharges ink droplets by using thermal energy. Additionally, the defective discharge and deflective discharge can also be caused if the nozzle holes are coated with ink droplets. When such defective discharge and deflective discharge occur, a streak-like unevenness may form on a recorded image in a scanning direction of the recording head, thus impairing the quality of the recorded image. Moreover, there is also a case where the rate of discharge of ink droplets (which will be referred to as "discharge rate" hereinafter) becomes lower, which can also lower the quality of a recorded image.

Various techniques for detecting a defective discharge using a light emitting element and a light receiving element have been proposed. One proposed technique is referred to as an optical defective-discharge detecting technique. According to this technique, when an ink droplet is discharged, the ink droplet passes through a light beam emitted from the light emitting element towards the light receiving element so that the ink droplet instantaneously blocks the light beam. This blocking of the light beam by the ink droplet causes the quantity of light received by the light receiving element to change, thereby changing an output from the light receiving element. Consequently, based on the change in the output, it is determined whether or not the ink droplet is discharged. For example, this technique is discussed in Japanese Patent Laid-Open No. 11-192726, and components thereof are shown in FIG. 8.

Referring to FIG. 8, a recording head 8 is provided, and a lower surface of the recording head 8 defines a discharge-nozzle surface 8*a*. The discharge-nozzle surface 8*a* is provided with a plurality of discharge nozzles. The recording head 8 is contained in a carriage, not shown. When the carriage moves, the recording head 8 is carried in a direction perpendicular to the page. In a state where the recording head

8 is at a predetermined position within a moving range thereof, a light emitting element 11 and a light receiving element 12 are positioned on opposite sides of an area below the discharge-nozzle surface 8*a* of the recording head 8, such that the light emitting element 11 and the light receiving element 12 face each other. Diaphragm plates 13', 14' are respectively disposed near front surfaces of the light emitting element 11 and the light receiving element 12 that face each other. The diaphragm plate 13' is provided with a single aperture 13*a*', and likewise, the diaphragm plate 14' is provided with a single aperture 14*a*'. FIG. 9 illustrates the diaphragm plate 14' as viewed from a side of the light emitting element 11 and shows an example of a shape and location of the aperture 14*a*'. In detail, the aperture 14*a*' is given a rectangular shape having a predetermined width W (of, for example, about 4 mm) and a predetermined height H (of, for example, about 2 mm). Likewise, the aperture 13*a*' is given the same shape and dimension. Furthermore, as viewed from the side of the light emitting element 11, the center of the aperture 14*a*' and the center of the light receiving element 12 are aligned with each other. Likewise, the aperture 13*a*' and the light emitting element 11 have the same relationship. When light is emitted from the light emitting element 11, a light beam 15 that passes through the apertures 13*a*' and 14*a*' (which will be referred to as a "detection beam" hereinafter) is received by the light receiving element 12. An optical path of the detection beam 15 extends parallel to the discharge-nozzle surface 8*a* of the recording head 8.

When performing a discharge-condition detection process, ink droplets are discharged from ink discharge nozzles in the discharge-nozzle surface 8*a* of the recording head 8 in a direction indicated by an arrow 18, which is perpendicular to the detection beam 15, and the ink droplets instantaneously block the detection beam 15. This changes the quantity of light received by the light receiving element 12, causing an output from the light receiving element 12 to change. The output from the light receiving element 12 is converted to an electric signal as a detection signal. Based on the detection signal, it can be determined whether or not the ink droplets are discharged.

FIG. 10 illustrates a waveform of a detection signal 17 based on the output from the light receiving element 12 and a waveform of a driving signal 16 when each of the nozzles of the recording head 8 is driven at a discharge frequency of 1 kHz.

In FIG. 10, the driving signal 16 is a C-MOS negative logic signal of 3.3 V. When the driving signal 16 decreases to 0 V, the nozzle is driven, thereby starting a discharge operation of an ink droplet from the nozzle. When the discharged ink droplet blocks the detection beam 15, the detection signal 17 is changed (is lowered to approximately −8 V) at a changing point indicated by an arrow 17*b*. The changing point 17*b* indicates that the detection beam 15 is blocked by the discharged ink droplet. Based on the presence of the changing point 17*b*, it can be determined whether or not the ink droplet was discharged.

However, even though it can be determined whether or not an ink droplet is discharged by using the above-referenced technique, the technique does not provide functions for detecting a deflective discharge and a discharge rate.

On the other hand, Japanese Patent Laid-Open No. 2003-276171 discloses an example of an apparatus for detecting a deflective discharge and a discharge rate. Specifically, in this example, a plurality of sets (for example, two sets) of discharge-condition detecting units are provided, each of which is the same as that shown in FIG. 8 and includes the light emitting element, the light receiving element, and the diaphragm plates. The plurality of sets of the discharge-condition detecting units is arranged in parallel to the discharge direction of ink droplets. According to this apparatus, in a case where the discharge direction is deflected as a result of deflective discharge, an ink droplet may block a detection beam of the discharge-condition detecting unit of the first set, but will not block a detection beam of the discharge-condition detecting unit of the second set. Based on this result, a deflective discharge can be detected. Moreover, by measuring the time between a point at which the ink droplet blocks the detection beam of the first set and a point at which the ink droplet blocks the detection beam of the second set, a discharge rate can be determined.

However, the apparatus of Japanese Patent Laid-Open No. 2003-276171 provided with the plurality of sets of discharge-condition detecting units leads to an increase in the cost of components. Moreover, a large installation space is necessary for the plurality of sets of discharge-condition detecting units, which leads to an increase in the overall size of the recording device. Furthermore, it is also required that the distance between the center of the first discharge-condition detecting unit and the center of the second discharge-condition detecting unit onward be equal to or greater than the size of the light emitting elements or the light receiving elements. This implies that the distance between the detection beams of the plurality of discharge-condition detecting units also becomes large, thus lowering the detection accuracy for detecting a deflective discharge. It is possible to reduce the distance between the plurality of sets of discharge-condition detecting units to some extent by using small-size, high-intensity light emitting elements and small-size light receiving elements. However, this is not preferable since small-size, high-intensity light emitting elements are expensive, and small-size light receiving elements have low sensitivity due to having a small light receiving area.

SUMMARY OF THE INVENTION

Embodiments of the present invention provide a droplet discharge-condition detecting unit that detects a discharge condition of a droplet discharged from a droplet discharger of a droplet-discharging device, such as an inkjet recording device.

According to an aspect of the present invention, a droplet discharge-condition detecting unit includes at least one light emitting element and a single light receiving element disposed on opposite sides of an area through which a droplet discharged from a droplet discharger of a droplet-discharging device passes. The droplet discharge-condition detection unit further includes a first diaphragm plate is disposed near a front surface of the light receiving element that faces the at least one light emitting element. The first diaphragm plate has a plurality of apertures arranged at a pitch in a discharge direction of the droplet. When the light emitting element emits light towards the light receiving element, the light travels across the area and passes through the plurality of apertures in the first diaphragm plate so that a plurality of light beams are received by the light receiving element. When the droplet is discharged, the plurality of light beams is blocked, causing a change in a quantity of light received by the light receiving element. The change in the quantity of light causes an output from the light receiving element to change. The droplet discharge-condition detecting unit detects a discharge condition of the droplet on the basis of the change in the output.

According to another aspect of the present invention, an inkjet recording device includes a guide shaft, a carriage slidably coupled to the guide shaft, and a recording head coupled to the carriage to discharge an ink droplet. The inkjet recording device further includes a droplet discharge-condition detecting unit having a light emitting element, a light receiving element, and a first plate disposed in front of the light receiving element. The first plate includes a first aperture and a second aperture positioned such that a detection beam emitted by the light emitting element passes through the apertures causing a first light beam and a second light beam, respectively, to be received by the light receiving element, the light emitting element emitting the detection beam in a direction which traverses a path of the ink droplet discharged from the recording head.

According to a further aspect of the present invention, a method is provided for detecting a discharge condition. The method includes emitting a detection beam towards the light receiving element through a first aperture and a second aperture such that a first light beam and a second light are received by the light receiving element which has a plate having the first aperture and the second aperture front thereof, wherein the emitting emits the detection beam in a direction which traverses a path of a droplet discharged from a droplet discharger of a droplet-discharging device. The method further includes detecting a first change in an output from the light receiving element caused by a droplet passing in front of the first aperture, and detecting a second change in the output from the light receiving element caused by the droplet passing in front of the second aperture.

Further features and aspects of the present invention will become apparent from the following description of exemplary embodiments.

DESCRIPTION OF THE EMBODIMENTS

Exemplary embodiments of the present invention will now be described with reference to the attached drawings. Each of exemplary embodiments below will be directed to an apparatus (which is also referred herein as an "ink-droplet discharge-condition detection unit", "discharge-condition detection unit" or "detection unit") for detecting discharge conditions of ink droplets discharged from a recording head included in an inkjet recording device. The inkjet recording device is, for example, a Bubble-Jet™ type, which is provided with heaters for nozzles of the recording head. In this type, the heaters are heated to form bubbles in the ink inside the nozzles, and the pressure of the bubbles forces ink droplets to be discharged from the nozzles.

First Exemplary Embodiment

Figure 1A:
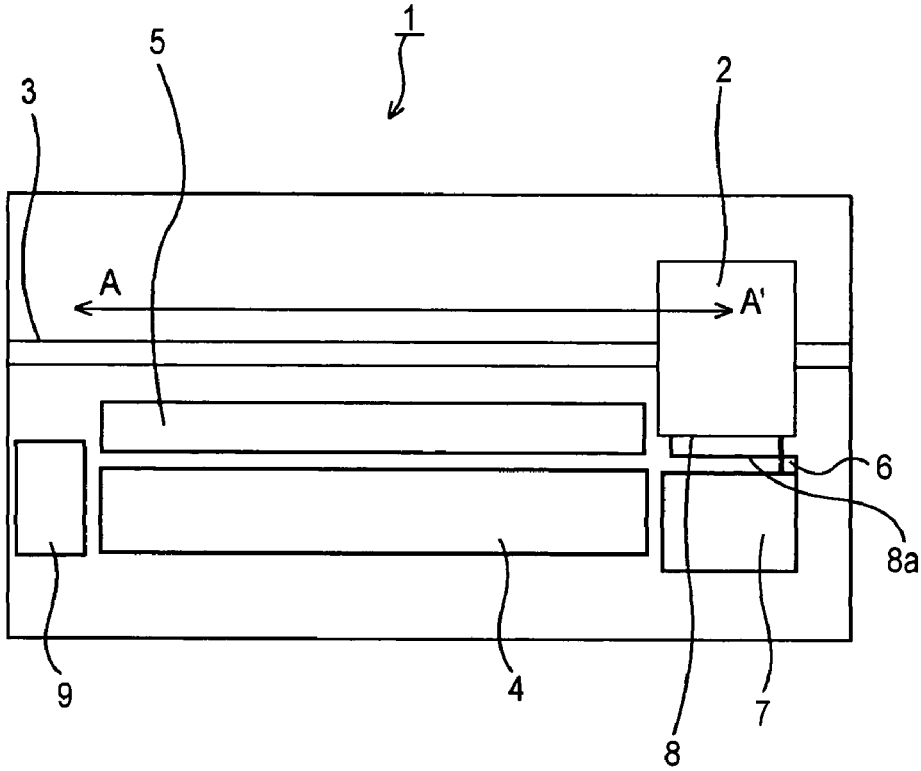
FIG. 1A is a vertical sectional view of an inkjet recording device according to a first embodiment of the present invention as viewed from the front thereof.
Figure 1B:
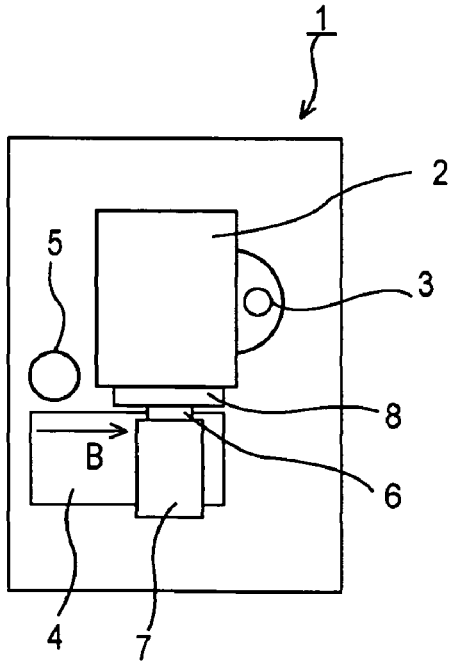
FIG. 1B is a vertical sectional view of the inkjet recording device according to the first embodiment of the present invention as viewed from a side thereof.

FIGS. 1A and 1B illustrate an exemplary inkjet recording device 1 (which is also referred to as a "recording device" hereinafter) serving as a serial printer equipped with an ink-droplet discharge-condition detecting unit according to a first embodiment of the present invention. Specifically, FIG. 1A is a front view of the recording device 1, and FIG. 1B is a side view of the recording device 1.

Referring to FIGS. 1A and 1B, a carriage 2 is slidably attached to a guide shaft 3, and is movable back and forth in directions A, A' indicated by a double-sided arrow in response to a rotation of a motor, not shown. One of or each of the directions A, A' defines a main scanning direction.

Figure 3:
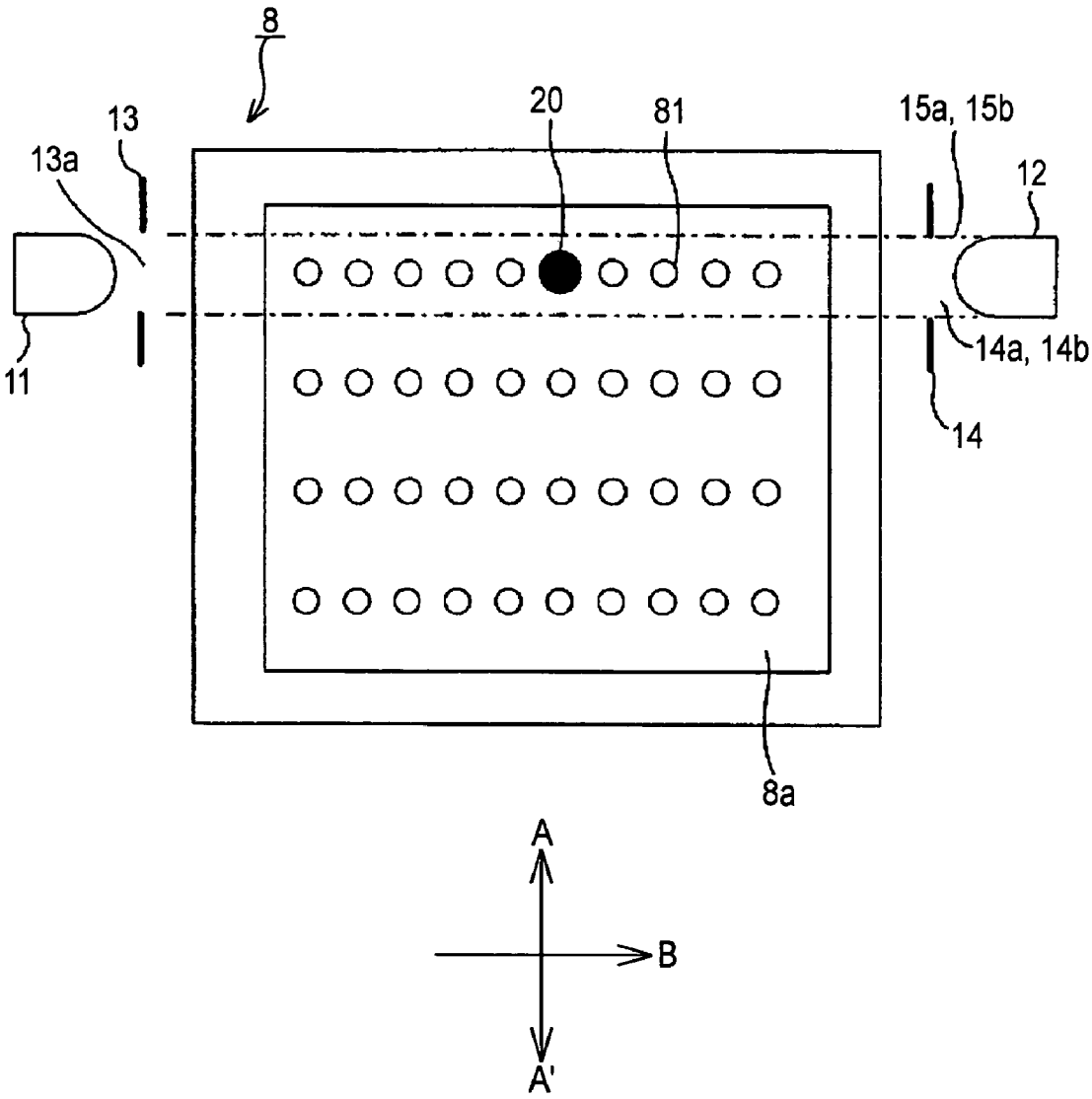
FIG. 3 illustrates components and positioning of the ink-droplet discharge-condition detecting unit as viewed towards a lower surface of the recording head shown in FIG. 2, according to an exemplary embodiment of the present invention.

The carriage 2 contains a recording head 8 which faces downward and functions as a droplet discharger configured to discharge ink droplets. A lower surface of the recording head 8 defines a discharge-nozzle surface 8*a*. Referring to FIG. 3, an exemplary discharge-nozzle surface 8*a* is shown with a plurality of discharge nozzles 81 configured to discharge ink droplets 20 therefrom. More specifically, in the illustrated embodiment, the discharge nozzles 81 shown in FIG. 3 are divided into four nozzle groups that correspond to four ink colors, cyan, magenta, yellow, and black. Each nozzle group includes a predetermined number of nozzles that are arrayed in a sub-scanning direction indicated by an arrow B (shown in FIG. 1B). Thus, the nozzle groups form four rows that are arranged at a predetermined pitch in the main scanning direction A, A'.

Referring back to FIGS. 1A and 1B, a platen 4 is disposed below the moving range of the carriage 2. In response to a rotation of a feed roller 5, a recording medium (recording sheet), not shown, is conveyed above the platen 4 in a direction perpendicular to the main scanning direction, that is, in the sub-scanning direction B. Ink droplets are discharged sequentially towards the recording medium from the nozzles of the recording head 8 that moves together with the carriage 2. Thus, the ink droplets land on the recording medium, thereby forming an image on the recording medium.

Referring to FIG. 1A, a recovery unit 7 equipped with a wiper 6 is disposed at a home position, which is, in the illustrated embodiment, at the right end of the moving range of the carriage 2, i.e. the right end of the moving range of the recording head 8. In a case where an ink discharge failure occurs in the recording head 8, the recovery unit 7 may perform a discharge recovery process. A discharge recovery process includes, for example, wiping off foreign particles adhered to the discharge-nozzle surface 8*a* of the recording head 8 using the wiper 6, and vacuuming out ink from the nozzles of the recording head 8.

Furthermore, a discharge-condition detecting unit 9 serving as the ink-droplet discharge-condition detecting unit mentioned above is disposed in a non-recording region, which is, in the illustrated embodiment, at the left end of the moving range of the recording head 8 in FIG. 1A. The discharge-condition detecting unit 9 is configured to detect discharge conditions of ink droplets discharged from the nozzles of the recording head 8. The detection of discharge conditions may include detecting whether or not ink droplets are discharged (which will be referred to as "proper/defective discharge" hereinafter), detecting whether the discharge direction is deflected (which will be referred to as "deflective discharge" hereinafter), and detecting the rate of discharge (which will be referred to as "discharge rate" hereinafter).

Figure 2:
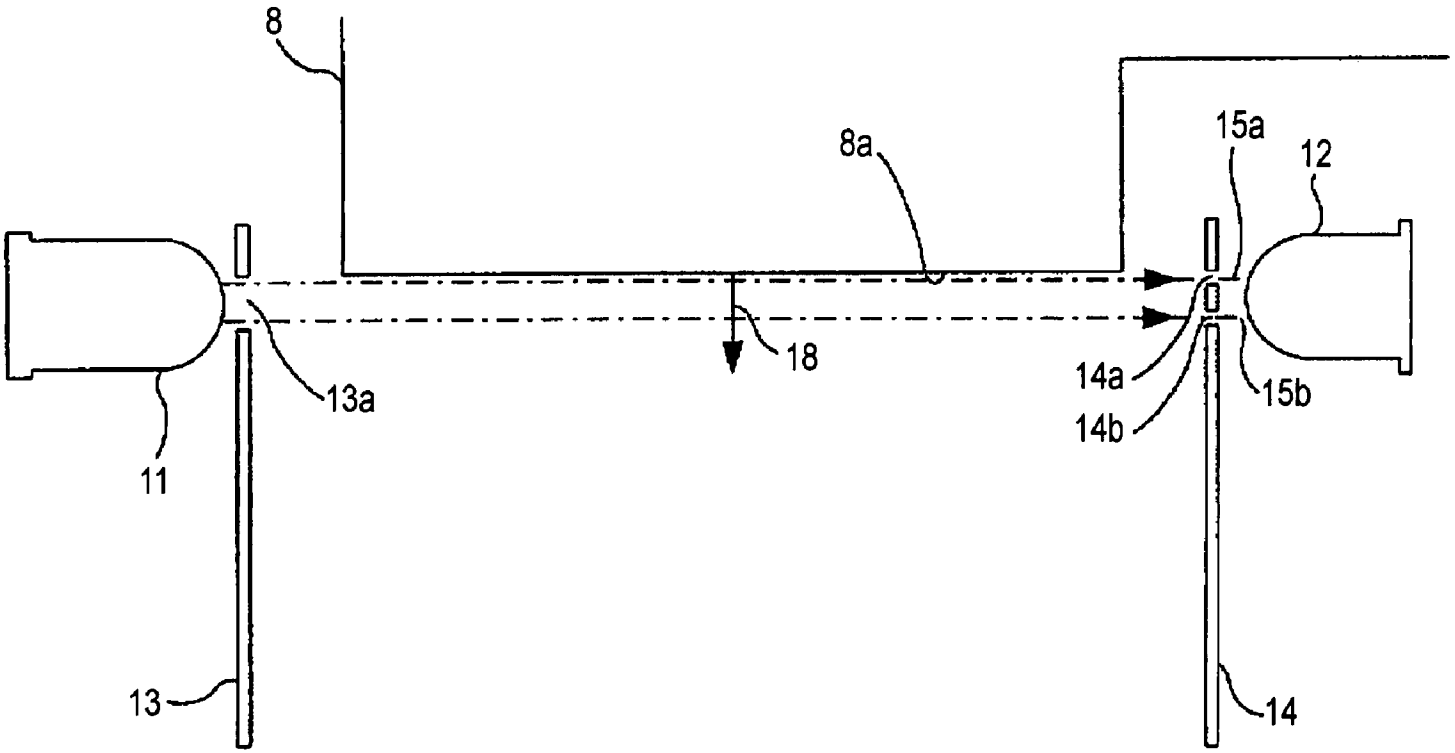
FIG. 2 illustrates components of an ink-droplet discharge-condition detection unit and positioning thereof with respect to a recording head provided in an inkjet recording device, according to an exemplary embodiment of the present invention.

Referring to FIGS. 2 and 3, the discharge-condition detecting unit 9 includes a light emitting element 11, a light receiving element 12, and diaphragm plates 13, 14. For example, a high-directivity infrared LED may be used as the light emitting element 11, and a photodiode may be used as the light receiving element 12. In a case where the recording head 8 is positioned above the discharge-condition detecting unit 9, the light emitting element 11 and the light receiving element 12 are positioned on opposite sides of an area below the discharge-nozzle surface 8*a* of the recording head 8 (i.e. an area through which the ink droplets 20 discharged from the discharge nozzles 81 passes) so as to face each other in the sub-scanning direction B from predetermined positions in the main scanning direction A, A'. Furthermore, as viewed in the sub-scanning direction B, an optical path extending between the centers of the light emitting element 11 and the light receiving element 12 is parallel to the discharge-nozzle surface 8*a* of the recording head 8, and is also parallel to the direction in which each of the four rows of nozzles extends.

The diaphragm plates 13, 14 are configured to adjust the quantity of light and are provided for improving the signal-to-noise ratio of a detection signal. The diaphragm plate 13 is disposed facing the light emitting element 11 at a position near the front surface of the light emitting element 11 that faces the light receiving element 12. Similarly, the diaphragm plate 14 is disposed facing the light receiving element 12 at a position near the front surface of the light receiving element 12 that faces the light emitting element 11. Furthermore, the diaphragm plates 13, 14 are disposed perpendicular to the optical path extending between the centers of the light emitting element 11 and the light receiving element 12.

The diaphragm plate 13 disposed near the light emitting element 11 is provided with a single aperture 13*a*. In an exemplary embodiment, the aperture 13*a* has an elongated rectangular shape that extends longitudinally in a direction perpendicular to a proper discharge direction 18 of ink droplets. For example, a width W of the rectangle (i.e. the length of each longitudinal side of the rectangle) is set to about 4 mm, and a height H is set to about 2 mm. Furthermore, as viewed in the sub-scanning direction B in which the light emitting element 11 and the light receiving element 12 face each other, the center of the aperture 13*a* and the center of the light emitting element 11 are aligned with each other. Moreover, the diaphragm plate 13 is disposed in a manner such that the aperture 13*a* preferably fits within a circular region which faces the light emitting element 11 of a cylindrical shape and which has the same diameter as the light emitting element 11.

Figure 4:
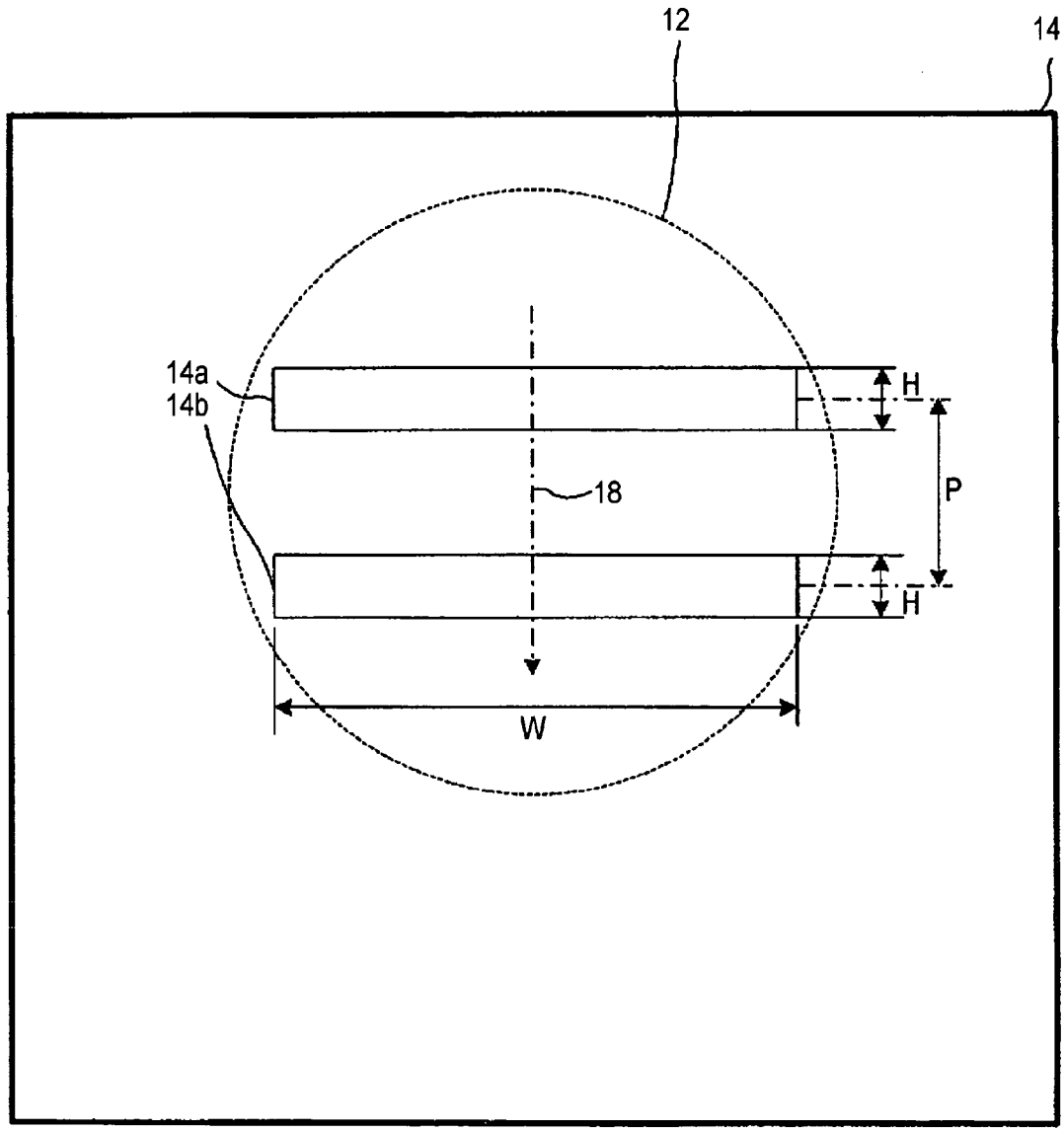
FIG. 4 is a front view of a diaphragm plate disposed near a light receiving element shown in FIGS. 2 and 3 as viewed from a side of a light emitting element, and shows a shape, dimension, and location of two apertures provided in the diaphragm plate, according to an exemplary embodiment of the present invention.

The diaphragm plate 14 disposed near the light receiving element 12 is provided with two apertures 14*a*, 14*b* that are arranged at a pitch in the proper discharge direction 18 of ink droplets discharged from the recording head 8. The shape and location of exemplary apertures 14*a*, 14*b* are shown in FIG. 4. Specifically, in the illustrated embodiment, the apertures 14*a*, 14*b* are both given an elongated rectangular shape with the same dimension. For example, each of the apertures 14*a*, 14*b* has a width W (i.e. the length of each longitudinal side of the rectangle) of about 4 mm, and a height H of about 0.5 mm. Moreover, the longitudinal sides of each rectangle extend perpendicular to the discharge direction 18 of ink droplets. A pitch P between the apertures 14*a*, 14*b* in the discharge direction 18 (i.e. the distance between the centers of the apertures 14*a*, 14*b*) is set to, for example, about 1.5 mm. The pitch P is not limited to 1.5 mm. For example, the pitch P is determined according to resolution of light receiving element 12.

In FIG. 4, as viewed in the sub-scanning direction B extending perpendicular to the page, the center of a region within which the two apertures 14*a*, 14*b* of the diaphragm plate 14 are disposed and the center of the light receiving element 12 are aligned with each other. Moreover, the diaphragm plate 14 is disposed in a manner such that the two apertures 14*a*, 14*b* fit within a circular region which faces the light receiving element 12 of a cylindrical shape and which has the same diameter as the light receiving element 12. Furthermore, the upper longitudinal side of the aperture 13*a* and the upper longitudinal side of the aperture 14*a* are positioned at the same height, and moreover, are positioned at the same height as or slightly lower than the discharge-nozzle surface 8*a*.

According to the positioning of the diaphragm plates 13, 14 as described above, when light emitted from the light emitting element 11 passes through the aperture 13*a* and then through the apertures 14*a*, 14*b*, two light beams 15*a*, 15*b* (shown in FIG. 2) (which will be referred to as "detection beams" hereinafter) are received by the light receiving element 12. The detection beams 15*a*, 15*b* are parallel to the discharge-nozzle surface 8*a* of the recording head 8 and are also parallel to the direction in which each of the four rows of nozzles extends. In correspondence with the apertures 14*a*, 14*b*, the detection beams 15*a*, 15*b* are arranged at a predetermined pitch in the discharge direction 18. Therefore, when an ink droplet is discharged in the discharge direction 18, the detection beams 15*a*, 15*b* are blocked by the ink droplet with a certain time lag. Accordingly, in addition to having an ability to detect whether or not the ink droplet is discharged, a deflective discharge and a discharge rate can also be detected based on an examination of the time lag.

A detection process for the discharge conditions of ink droplets discharged from the discharge nozzles 81 of the recording head 8 will now be described. When performing a detection process, the carriage 2 is first driven so as to move the recording head 8 in the main scanning direction A, A' to a position shown in FIG. 3. In other words, the recording head 8 is moved so that the first row of the four nozzle groups in the direction of the arrow A is positioned directly above the detection beams 15*a*, 15*b*. The discharge nozzles 81 in the first row are then driven sequentially in a one-by-one fashion. More specifically, in an exemplary embodiment, the discharge nozzles 81 are respectively provided with heaters, not shown, which sequentially generate heat so as to heat the ink in the nozzles 81. This forms bubbles in the ink, and the pressure of the bubbles forces the ink droplets 20 to be discharged from the nozzles 81. If each of the ink droplets 20 is discharged in the proper discharge direction 18, the ink droplet 20 sequentially passes through the detection beams 15*a*, 15*b* so as to block the detection beams 15*a*, 15*b* sequentially. After blocking the detection beams 15*a*, 15*b*, the ink droplet 20 lands on an ink absorber, not shown, provided in the discharge-condition detecting unit 9 so as to become absorbed by the ink absorber.

This blocking of the detection beams 15*a*, 15*b* by the ink droplet 20 causes the quantity of light received by the light receiving element 12 to change (to decrease), thereby inducing a change in an output from the light receiving element 12. The output from the light receiving element 12 is, for example, amplified by a signal processing circuit, not shown, so as to be converted to a detection signal. Based on a waveform of the detection signal, the discharge conditions including the proper/defective discharge, deflective discharge, and discharge rate can be determined.

Figure 5:
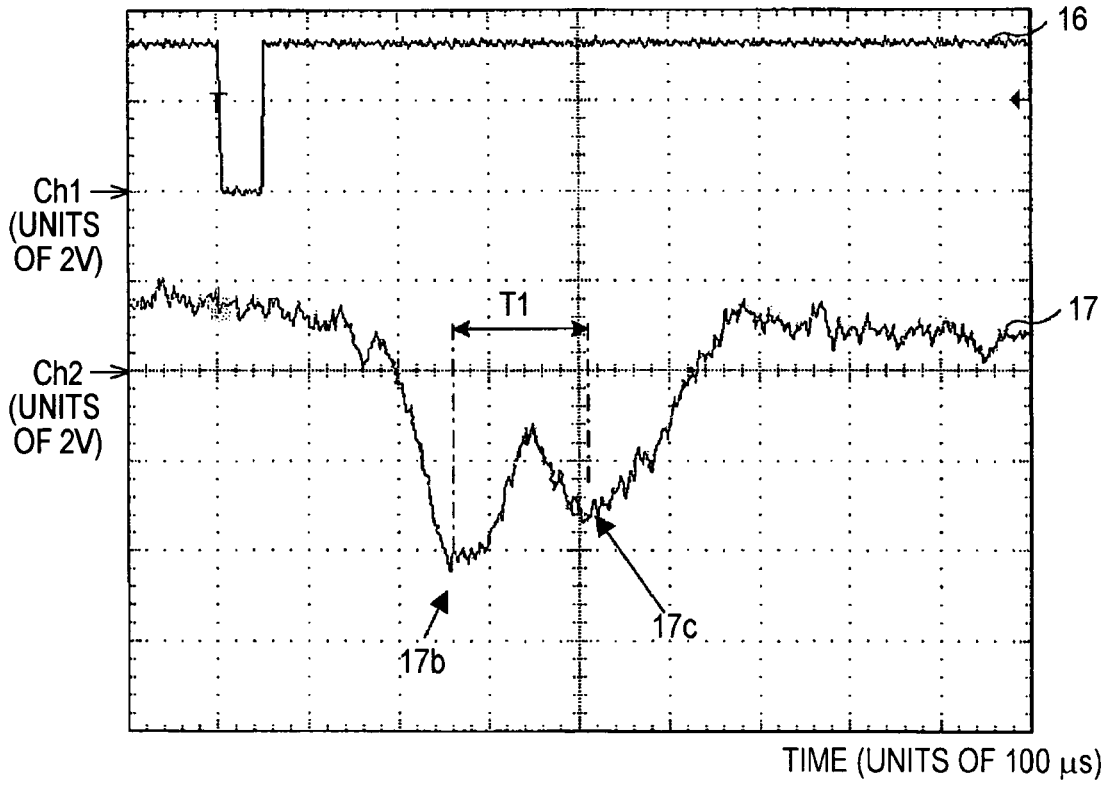
FIG. 5 is a diagram illustrating a waveform of a discharge-condition detection signal and a waveform of a driving signal for one of nozzles included in the recording head according to the first embodiment.

FIG. 5 illustrates a waveform of a discharge-condition detection signal 17 and a waveform of a driving signal 16 for one of the discharge nozzles 81 of the recording head 8 obtained when the discharge nozzle 81 is driven at a discharge frequency of, for example, 1 kHz for the discharge-condition detection process. The detection signal 17, shown in FIG. 5, corresponds to a case where the driving conditions are normal. The vertical axis in FIG. 5 represents the voltage level in units of 2 V, such that there is a voltage-level difference of 2 V between adjacent dotted lines. On the other hand, the horizontal axis represents time in units of 100 μs, such that there is a time difference of 100 μs between adjacent dotted lines. In an exemplary embodiment, the driving signal 16 is a C-MOS negative logic signal of 3.3 V, and the voltage at a level indicated by an arrow Ch1 on the vertical axis is 0 V. As the driving signal 16 decreases from 3.3 V to 0 V, when the driving signal 16 passes 2 V, the heater in the discharge nozzle 81 is triggered. Thus, the heater heats the ink in the discharge nozzle 81, thereby starting a discharge operation of an ink droplet.

The voltage of the detection signal 17 at a level indicated by an arrow Ch2 is 0 V. The voltage of the detection signal 17 decreases in accordance with a decrease in the quantity of light received by the light receiving element 12. After the start of the discharge operation, the voltage decreases to approximately −4 V at a first changing point indicated by an arrow 17*b*. The first changing point 17*b* indicates that the discharged ink droplet has blocked the detection beam 15*a* by passing in front of the aperture 14*a*. Subsequently, the voltage of the detection signal 17 increases back to about −1 V, but then decreases again to −3 V or lower at a second changing point indicated by an arrow 17*c*. The second changing point 17*c* indicates that the discharged ink droplet has blocked the detection beam 15*b* by passing in front of the aperture 14*b*. On the basis of such changes in the voltage of the detection signal 17 having the first and second changing points 117*b*, 117*c*, it can be determined that the ink droplet was properly discharged from the one nozzle driven in the course of the decrease in the voltage of the detection signal 17.

On the other hand, if an ink droplet is not discharged from the one driven nozzle, both first changing point 117*b* and second changing point 117*c* will not appear on the waveform of the detection signal 17 since the detection beams 15*a*, 15*b* are not subject to blocking. Therefore, it can be determined that an ink droplet was not discharged from the one nozzle (defective discharge).

Furthermore, if the ink droplet discharged from the one nozzle is deflected such that the discharge direction of the ink droplet is deflected from the proper discharge direction 18 by a predetermined angle of θmin or more in the direction of the width W of the apertures 14*a*, 14*b* (i.e. the width of the detection beams 15*a*, 15*b*), the discharged ink droplet may pass through the detection beam 15*a* to block the detection beam 15*a*, but may not block the detection beam 15*b*. In a case where a discharged droplet does not block the second detection beam 15*b*, the first changing point 17*b* may appear on the waveform of the detection signal 17, but the second changing point 17*c* will not. Accordingly, a deflective discharge can be detected. The predetermined angle θmin will be referred to as a minimum-deflection detection angle hereinafter. By changing the settings for the width W of the apertures 14*a*, 14*b* and the pitch P between the apertures 14*a*, 14*b*, the minimum-deflection detection angle θmin can be changed, whereby the detection accuracy for detecting a deflective discharge can be adjusted. Moreover, in comparison to Japanese Patent Laid-Open No. 2003-276171 in which a plurality of sets of discharge-condition detecting units is provided, the distance between the two detection beams 15*a*, 15*b* corresponding to the pitch P can be reduced to a great extent in the present invention. Thus, the detection for deflective discharge can be performed with high accuracy.

Furthermore, a discharge rate of the discharged ink droplet can be determined on the basis of a time period T1 between the first and second changing points 17*b*, 17*c* of the detection signal 17. The time period T1 represents a time period in which the ink droplet travels through the pitch P between the apertures 14*a*, 14*b* (i.e. the pitch between the detection beams 15*a*, 15*b*). A discharge rate of the ink droplet can be calculated from the time period T1 and the pitch P. For example, referring to FIG. 5, if the time period T1 is 150 μs and the pitch P is 1.5 mm, a discharge rate can be calculated as follows: 1.5 mm±150 μs=10000 mm/s (=10 m/s). Accordingly, a discharge rate can be determined in this manner. It can be determined whether the discharge operation of the ink droplet was properly performed on the basis of whether the detected value of the discharge rate is within a permissible range with respect to a set value.

Similarly, the detection process for the discharge conditions including the proper/defective discharge, deflective discharge, and discharge rate is performed sequentially for the remaining nozzles in the nozzle group of the first row. When the detection process is completed for all of the nozzles in the first row, the recording head 8 is moved from the position shown in FIG. 3 in the main scanning direction A by a distance corresponding to the predetermined pitch at which the four rows of nozzles are arranged. In other words, the recording head 8 is moved so that the nozzle group of the second row is positioned directly above the detection beams 15*a*, 15*b*. Similar to the above, the detection process is performed for the nozzles in the second row onward.

Accordingly, the first embodiment requires only one set of the light emitting element 11 and the light receiving element 12 respectively provided with the diaphragm plates 13, 14. Moreover, the diaphragm plate 13 is provided with a single aperture 13*a*, and the diaphragm plate 14 is provided with the two apertures 14*a*, 14*b*. Therefore, the first embodiment achieves a simple, low-cost, space-saving discharge-condition detection unit. With this discharge-condition detection unit, in addition to having an ability to detect whether or not ink droplets are discharged from the discharge nozzles 81 of the recording head 8, a deflective discharge and a discharge rate can also be detected with high accuracy. Furthermore, the discharge-condition detecting unit 9 can be reduced in size, thereby contributing to an overall size reduction of the inkjet recording device.

Figure 10:
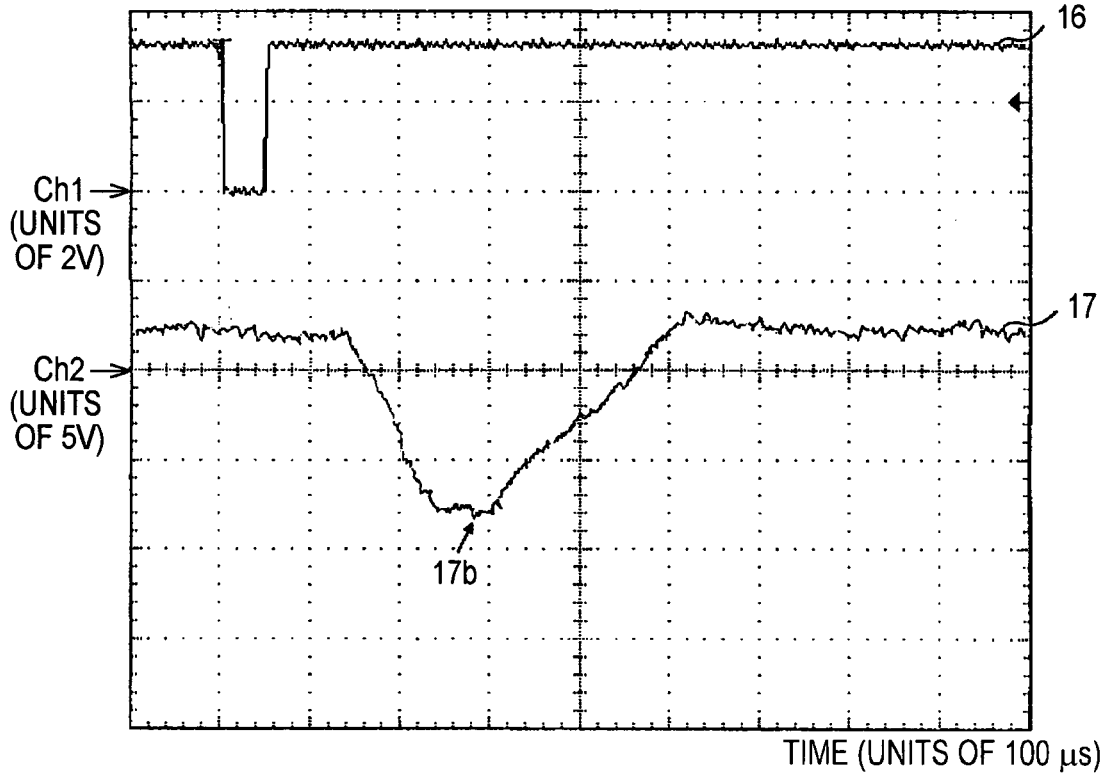
FIG. 10 PRIOR ART
FIG. 10 is a diagram illustrating a waveform of a detection signal and a waveform of a driving signal for one of nozzles included in a recording head of the conventional inkjet recording device.

It is noted that, although the waveforms of the driving signal 16 and the detection signal 17 in FIG. 10 are shown similar to a signal waveform diagram of FIG. 5 corresponding to that first embodiment of the present invention, the range of the detection signal 17 is different between the two diagrams. Specifically, the vertical axis in FIG. 5 represents the voltage level in units of 2 V such that there is a voltage-level difference of 2 V between adjacent dotted lines, whereas the vertical axis in FIG. 10 represents the voltage level in units of 5 V.

Second Exemplary Embodiment

Figure 6:
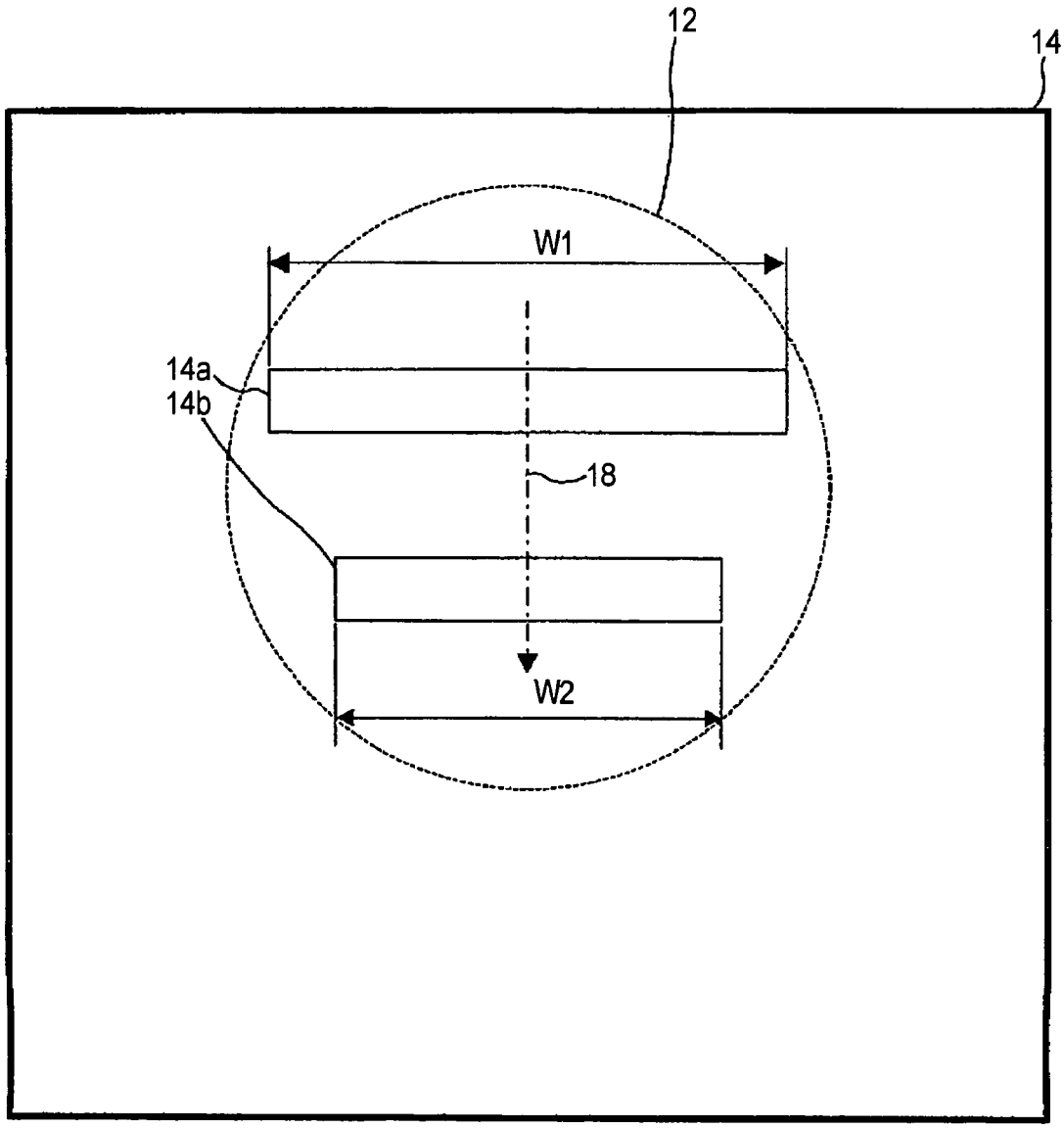
FIG. 6 is a front view of a diaphragm plate disposed near the light receiving element according to a second embodiment of the present invention, and illustrates shapes, dimensions, and locations of two apertures provided in the diaphragm plate.

In the first embodiment, the apertures 14*a*, 14*b* of the diaphragm plate 14 shown in FIG. 4 are given the same width W (i.e. the same longitudinal length). In contrast, according to a second embodiment of the present invention shown in FIG. 6, the aperture 14*a* and the aperture 14*b* are given different widths W1, W2, respectively. In this case (W1>W2), if the width W1 of the aperture 14*a* is the same as the width W (shown in FIG. 4) in the first embodiment, and the height and location of the apertures 14*a*, 14*b* are also the same as those in the first embodiment, the minimum-deflection detection angle θmin in the second embodiment becomes smaller than that in the first embodiment. This means that a deflective discharge can be detected in a more precise manner.

Third Exemplary Embodiment

Figure 7:
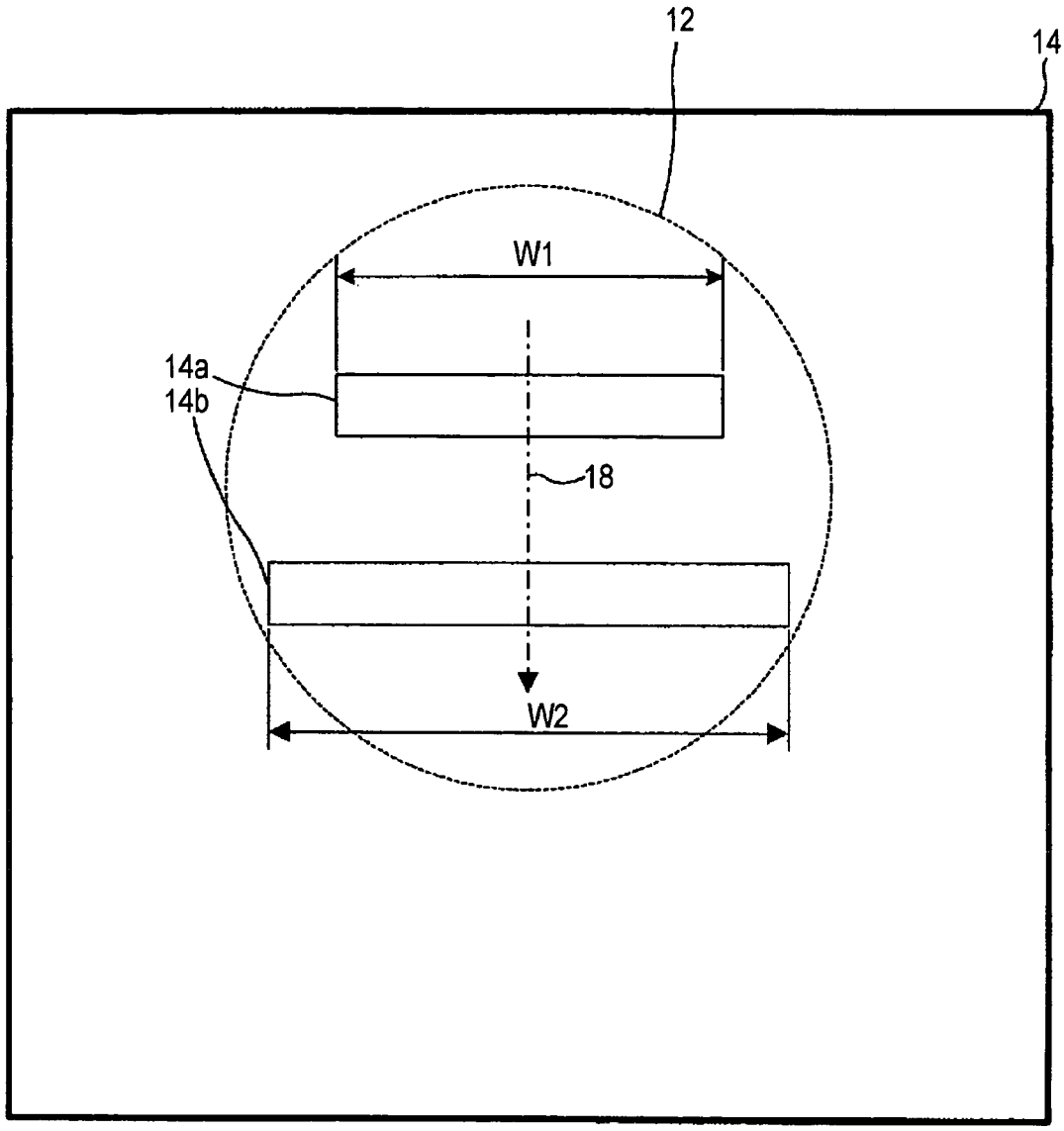
FIG. 7 is a front view of a diaphragm plate disposed near the light receiving element according to a third embodiment of the present invention, and illustrates shapes, dimensions, and locations of two apertures provided in the diaphragm plate.
Figure 8:
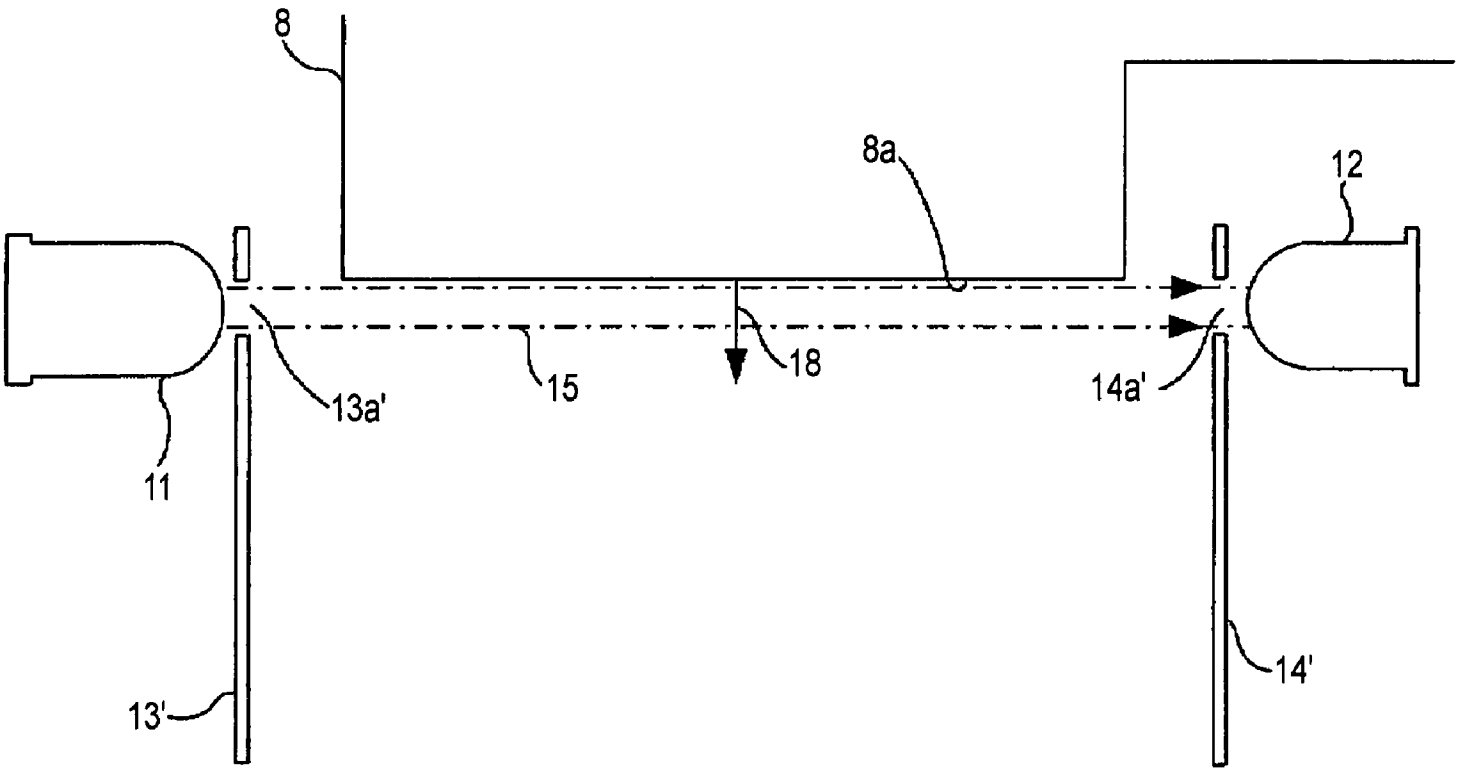
FIG. 8 PRIOR ART
FIG. 8 illustrates a structure and positioning of a detecting unit configured to detect discharge conditions of ink droplets discharged from a recording head provided in a conventional inkjet recording device.
Figure 9:
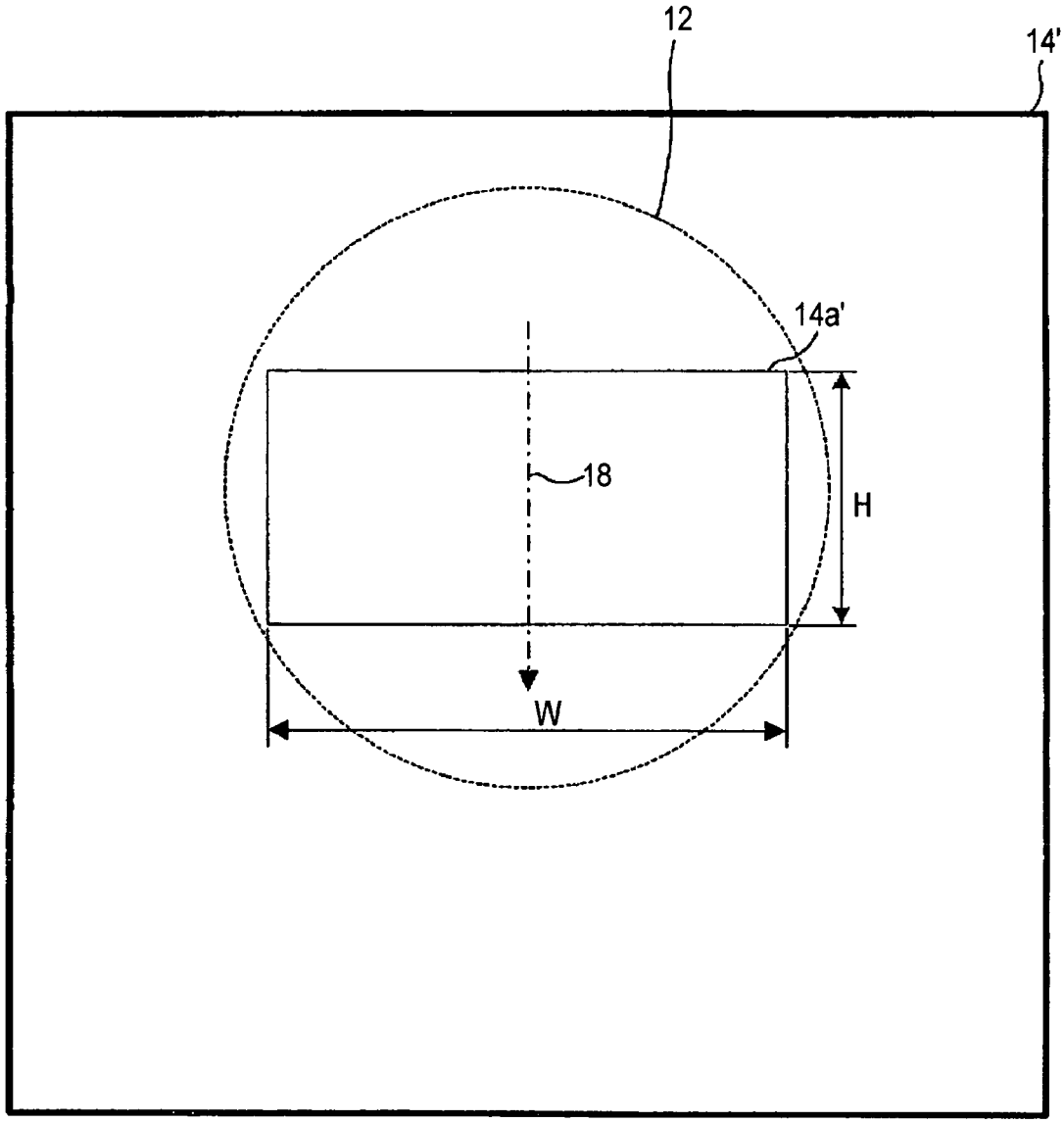
FIG. 9 PRIOR ART
FIG. 9 is a front view of a conventional diaphragm plate disposed near a light receiving element shown in FIG. 8, and illustrates a shape, dimension, and location of a single aperture provided in the diaphragm plate.

Furthermore, according to a third embodiment of the present invention shown in FIG. 7, the width W1 of the aperture 14*a* may be set smaller than the width W2 of the aperture 14*b*. In this case (W1<W2), if the width W2 of the aperture 14*b* is the same as the width W (shown in FIG. 4) in the first embodiment, and the height and location of the apertures 14*a*, 14*b* are also the same as those in the first embodiment, the minimum-deflection detection angle θmin in the third embodiment becomes larger than that in the first embodiment. This means that a deflective discharge can be detected in a more moderate manner.

Fourth Exemplary Embodiment

In the first to third embodiments, the diaphragm plate 14 is provided with the two apertures 14*a*, 14*b* that are arranged at a predetermined pitch in the discharge direction 18 of ink droplets. Alternatively, according to a fourth embodiment of the present invention, the diaphragm plate 14 may be provided with three or more apertures that are arranged at a predetermined pitch in the discharge direction 18 of ink droplets. In that case, when light emitted from the light emitting element 11 pass through the three or more apertures, three or more light beams are received by the light receiving element 12. Each of the light beams is blocked by an ink droplet discharged in the proper discharge direction 18. Accordingly, the detection process for the discharge conditions including the proper/defective discharge, deflective discharge, and discharge rate can be performed in substantially the same or similar manner as in the first embodiment.

Furthermore, in a case where a diaphragm plate having three or more apertures is used, the first and second apertures that are closer to the discharge-nozzle surface 8*a* of the recording head 8 may be used for detecting a discharge rate of ink droplets and the third aperture onward may be used for detecting a deflective discharge. In that case, the width of the first and second apertures and the width of the third aperture onward may be set individually to optimal widths that are suitable for the intended detecting purposes. Accordingly, a discharge rate and a deflective discharge can be detected with even higher accuracy.

Although the apertures 14*a*, 14*b* of the diaphragm plate 14 are given a rectangular shape in the above embodiments, the shape of the apertures 14*a*, 14*b* does not necessarily have to be an exact rectangle. Alternatively, the apertures 14*a*, 14*b* may have a substantially rectangular shape whose two opposing longitudinal sides are parallel or substantially parallel to each other. Furthermore, the longitudinal sides of the apertures 14*a*, 14*b* do not have to be exactly perpendicular to the discharge direction 18, and may alternatively be substantially perpendicular to the discharge direction 18. Furthermore, the aperture 13*a* of the diaphragm plate 13 does not necessarily have to be rectangular, and the number of apertures 13*a* provided may be the same as that of the plurality of apertures provided in the diaphragm plate 14. As a further alternative, a plurality of the light emitting elements 11 may be provided. However, it is more preferable that only a single light emitting element 11 be provided in view of a simple, low-cost, space-saving structure. As a further alternative, a plurality of the light receiving elements 12 may be provided. In this case, detection signals from the plurality of the light receiving elements 12 are added to each other to output a signal 17 of FIG. 5. In this case, one light receiving element 12 is adapted to aperture 14*a* and another light receiving element 12 to aperture 14*b*. However, it is more preferable that only a single light emitting element 12 be provided in view of a simple, low-cost, space-saving structure.

Furthermore, the detecting function for the discharge conditions of ink droplets according to embodiments of the present invention is not limited to an inkjet recording device of a Bubble-Jet™ type as described in the above embodiments, and may be applied to other types of inkjet recording devices, such as a piezoelectric type. Furthermore, the detecting function for the discharge conditions according to embodiments of the present invention may be applied to a droplet-discharging device having a droplet discharger that is configured to discharge droplets other than ink liquid. For example, the droplets dischargeable from the droplet discharger may include droplets of a reaction liquid, a medical liquid, or a liquid that becomes a conductive material when dehydrated.

According to embodiments of the discharge-condition detecting unit of the present invention, a plurality of light beams incident on a light receiving element are arranged at a predetermined pitch in a proper discharge direction of droplets in correspondence with a plurality of apertures. Thus, a droplet discharged in the proper discharge direction blocks the light beams with a certain time lag. Consequently, this blocking of the light beams induces a change in the quantity of light received by the light receiving element, by which an output from the light receiving element is changed. Accordingly, in addition to having an ability to detect whether or not a droplet is discharged, a deflective discharge and a discharge rate can also be detected on the basis of the change in the output. Moreover, since the distance between the plurality of light beams can be reduced, a deflective discharge can be detected with high accuracy. The single light receiving element and the single light emitting element contributes to a simple, low-cost, space-saving structure. Accordingly, a droplet-discharging device, such as an inkjet recording device, equipped with this discharge-condition detecting unit can be advantageously reduced in size.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-173081 filed Jun. 14, 2005, which is hereby incorporated by reference herein in its entirety.

What is claimed is:

1. An ink droplet discharge-condition detecting unit, comprising:

at least one light emitting element, wherein each light emitting element is configured to emit a single light beam;

a light receiving element positioned to face one light emitting element to define an area there between through which an ink droplet discharged from an ink droplet-discharging device is configured to pass; and a first diaphragm plate disposed near a front surface of the light receiving element, the first diaphragm plate having a plurality of apertures arranged at a pitch in a discharge direction of the ink droplet, wherein when the one light emitting element emits a single light beam towards the light receiving element in a fixed state, the single light beam travels across the area and is separated into a plurality of detection beams as a result of passing through all the apertures of the plurality of apertures in the first diaphragm plate so that the plurality of detection beams is configured to be received by the light receiving element, wherein the plurality of detection beams includes a first detection beam and a second detection beam, wherein if a discharged ink droplet blocks only a portion of the single light beam, then a first quantity of light received by the light receiving element from the first detection beam will be different from a second quantity of light received at the same time by the light receiving element from the second detection beam, wherein a difference between the received first quantity of light and second quantity of light causes an output of the light receiving element to change, and wherein the ink droplet discharge-condition detecting unit is configured to detect a discharge condition of the ink droplet based on the change in the output of the light receiving element.

2. The ink droplet discharge-condition detection unit according to claim 1, wherein the first detection beam is positioned closer to the ink droplet-discharging device than the second detection beam, and wherein that portion of the single light beam that results in the first detection beam is blocked before that portion of the single light beam that results in the second detection beam when the ink droplet is discharged.

3. The ink droplet discharge-condition detecting unit according to claim 1, wherein ink droplet discharge-condition detecting unit includes no more than one light emitting element that emits no more than one light beam and includes no more than one light receiving element, the ink droplet discharge-condition detecting unit further comprising:

a second diaphragm plate having a single aperture, wherein the second diaphragm plate is disposed near a front surface of the no more than one light emitting element, wherein the no more than one light beam is configured to pass through the single aperture in the second diaphragm plate.

4. The ink droplet discharge-condition detecting unit according to claim 1, wherein the ink droplet discharge-condition detecting unit is configured to detect a discharge condition of an ink droplet discharged from a recording head of an inkjet recording device.

5. The ink droplet discharge-condition detecting unit according to claim 1, wherein each aperture of the plurality of apertures in the first diaphragm plate includes an elongated rectangular shape, such that longitudinal sides of a rectangular shape extend substantially perpendicular to the discharge direction of the ink droplet.

6. The ink droplet discharge-condition detecting unit according to claim 5, wherein a length of the longitudinal sides of each rectangular shape in the first diaphragm plate are the same length.

7. The droplet discharge-condition detecting unit according to claim 5, wherein a length of the longitudinal sides of a first rectangular aperture in the first diaphragm plate is different from a length of the longitudinal sides of a second rectangular aperture in the first diaphragm plate.

8. An inkjet recording device, comprising:

a recording head configured to discharge an ink droplet along a discharge direction; and an ink droplet discharge-condition detecting unit including a light emitting element, a light receiving element, a first plate having both a first aperture and a second aperture disposed in front of the light receiving element, wherein when a light beam emitted by the light emitting element in a fixed state passes in a direction that traverses the discharge direction and through both the first aperture and the second aperture, the light beam is separate into a first detection beam and a second detection beam, respectively, that are received by the light receiving element.

9. The inkjet recording device according to claim 8, wherein the ink droplet discharge-condition detecting unit is configured to determine a discharge condition of the ink droplet based on a first change in an output from the light receiving element and a second change in the output from the light receiving element.

10. The inkjet recording device according to claim 9, wherein the first change in the output from the light receiving element is caused by the ink droplet passing through the light beam in front of the first aperture; and wherein the second change in the output from the light receiving element is caused by the ink droplet passing through the light beam in front of the second aperture.

11. The inkjet recording device according to claim 10, wherein the ink droplet discharge-condition detecting unit is configured to determine a discharge rate of the ink droplet based on the first change and second change in the output from the light receiving element.

12. The inkjet recording device according to claim 8, wherein the first aperture is positioned closer to the recording head than the second aperture; and wherein the first aperture has a longitudinal side that is wider than a longitudinal side of the second aperture.

13. The inkjet recording device according to claim 8, wherein the first aperture is positioned closer to the recording head than the second aperture; and wherein the first aperture has a longitudinal side that is narrower than a longitudinal side of the second aperture.

14. The inkjet recording device according to claim 8, wherein a pitch between the first aperture and the second aperture is greater than 1 mm, and wherein the first aperture and the second aperture fit within a circular region that faces the light receiving element and has a diameter that is the same as a diameter of the light receiving element.

15. The inkjet recording device according to claim 8, further comprising:

a guide shaft; and a carriage slidably coupled to the guide shaft, wherein the carriage is configured to move the recording head forward and backward in a direction that is perpendicular to the light beam.

16. An ink droplet discharge-condition detecting method of detecting an ink droplet discharge-condition, the method comprising:

emitting a light beam in a direction that traverses a discharge direction of an ink droplet towards a light receiving element in a fixed state through a plate having a first aperture and a second aperture such that the light beam is divided into a first detection beam and a second detection beam as a result of the light beam passing through the plate;

receiving the first detection beam and the second detection beam in the light receiving element;

detecting a first change in an output from the light receiving element caused by the ink droplet passing through the light beam in front of the first aperture; and detecting a second change in the output from the light receiving element caused by the ink droplet passing through the light beam in front of the second aperture.

17. The method according to claim 16, further comprising:

determining a discharge condition of the ink droplet based on the first change and the second change in the output from the light receiving element.

18. The method according to claim 16, further comprising:

determining a discharge rate of the ink droplet based on the first change and the second change in the output from the light receiving element.

19. The method according to claim 16, further comprising:

determining a deflective discharge condition of the ink droplet based on detection of the first change and the second change in the output from the light receiving element.

* * * * *